United States Patent [19]

Kimball et al.

[11] 4,052,687

[45] Oct. 4, 1977

[54] CIRCUIT BREAKER WITH PARALLEL SHORTING ELEMENT

[75] Inventors: Stephen F. Kimball, Georgetown; Paul E. Gates, Danvers, both of Mass.

[73] Assignee: GTE Sylvania Incorporated, Danvers, Mass.

[21] Appl. No.: 612,599

[22] Filed: Sept. 12, 1975

[51] Int. Cl.[2] ..... H01H 61/00

[52] U.S. Cl. ..... 337/25; 337/27

[58] Field of Search ..... 337/98, 3, 4, 15, 16, 337/17, 22, 23, 24, 25, 27, 99

[56] References Cited

U.S. PATENT DOCUMENTS

| | | | |
|---|---|---|---|
| 2,542,149 | 2/1951 | Lemaigre-Voreaux | 337/25 |
| 3,105,889 | 10/1963 | Van Boort et al. | 337/24 |
| 3,272,944 | 9/1966 | Ricker et al. | 337/99 X |

*Primary Examiner*—George Harris

*Attorney, Agent, or Firm*—James Theodosopoulos

[57] ABSTRACT

A circuit breaker has a thermally sensitive bimetal connected across two lead-in wires in a glass envelope. An electrically conductive bypass element is in parallel with the bimetal and shorts it out. The bypass element can be removed from the circuit by melting it by means of a short duration pulse of high electric current.

2 Claims, 1 Drawing Figure

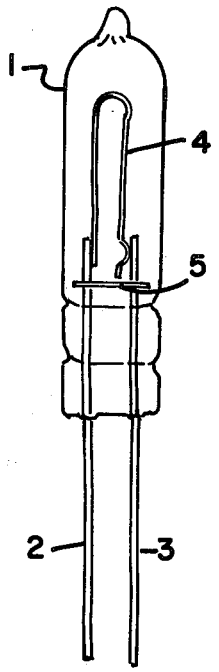
1
4
5
2
3

CIRCUIT BREAKER WITH PARALLEL SHORTING ELEMENT

THE INVENTION

This invention provides a thermally sensitive electrical circuit breaker element which is inoperative until it is deliberately processed to become operative. The necessity for such a circuit breaker occurs, for example, in a particular fluorescent lamp where the circuit breaker is in series with the filament of the lamp and opens after lamp warm-up to shut off filament current.

During lamp processing, the circuit breaker is subjected to temperatures sufficiently high to maintain the circuit breaker open. But it is necessary for the filament to be electrically heated by filament current therethrough during this time in order to break down the electron-emitting coating thereon. This invention solves the problem by providing an electrically conductive bypass element within the circuit breaker which conducts the current while the thermally sensitive bimetal is open but which can subsequently be meltably removed by a high current short duration pulse. During lamp processing, the bypass element permits current to flow through the circuit breaker even if the thermally sensitive bimetal thereof is open. After lamp processing is finished, the circuit breaker is made operative by electrically melting away the bypass element.

The single FIGURE in the drawing is an expanded elevational view of a circuit breaker in accordance with this invention.

As shown in the drawing, one embodiment of a circuit breaker in accordance with this invention comprises a sealed glass envelope 1 having lead-in wires 2 and 3 extending therethrough. In one example, glass envelope 1 was 150 mils diameter by $\frac{5}{8}$ inch long and lead-in wires 2 and 3 were made of 20 mil dumet wire.

Fastened to the inner end of lead-in wire 2 was a U-shaped bimetal 4 which made contact with the inner end of lead-in wire 3 at room temperature. At elevated temperatures, for example, 160° C, bimetal 4 deflects away from lead-in wire 4, thereby breaking electrical contact therewith. Contact is reestablished when the breaker cools below about 150° C.

Internally connected across lead-in wires 2 and 3, in parallel electrically with bimetal 4, was an electrically conductive bypass element 5. In this example, bypass element 5 was a short piece of refractory metal wire, specifically 3 mil molybdenum wire, welded to lead-in wires 2 and 3. As long as bypass element 5 was intact, electric current could flow through the circuit breaker, even if bimetal 4 was open.

After the circuit breaker had been installed, for example, in a fluorescent lamp, and after bypass element 5 permitted filament breakdown current through the circuit breaker under lamp processing conditions that maintained bimetal 4 open, bypass element 5 was removed from the circuit by a high current, short duration pulse, from a capacitor, for example, which melted the molybdenum wire. The circuit breaker was now operative to shut off lamp filament current when bimetal 4 becomes heated to its opening temperature of 160° C.

We claim:

1. A circuit breaker comprising a sealed glass envelope having two lead-in wires extending therethrough, a thermally sensitive bimetal within said envelope mounted on one of said lead-in wires and making electrical connection to the other at room temperature but separated therefrom at a predetermined elevated temperature, and an electrically conductive bypass element within said envelope across said lead-in wires in parallel with said bimetal, wherein said bypass element can be melted by a short duration pulse of high electric current.

2. The circuit breaker of claim 1 wherein said bypass element comprises refractory metal wire.

* * * * *